US009671190B1

(12) United States Patent
Small

(10) Patent No.: US 9,671,190 B1
(45) Date of Patent: Jun. 6, 2017

(54) HINGED ARCHERY SIGHT FOR A BOW FOR SHOOTING ARROWS

(71) Applicant: Alan J. Small, Rifton, NY (US)

(72) Inventor: Alan J. Small, Rifton, NY (US)

( * ) Notice: Subject to any disclaimer, the term of this patent is extended or adjusted under 35 U.S.C. 154(b) by 0 days.

(21) Appl. No.: 15/004,937

(22) Filed: Jan. 23, 2016

(51) Int. Cl.
*F41G 1/467* (2006.01)
*F41B 5/14* (2006.01)

(52) U.S. Cl.
CPC ..... *F41B 5/1419* (2013.01); *F41G 1/467* (2013.01)

(58) Field of Classification Search
CPC ..... F41B 5/1419; F41G 1/467
USPC ..... 124/86, 87, 90; 33/265
See application file for complete search history.

(56) References Cited

U.S. PATENT DOCUMENTS 3,410,644 A * 11/1968 McLendon ..... F41G 1/467 124/24.1
3,703,770 A * 11/1972 Sofield ..... F41G 1/467 33/265
4,011,853 A * 3/1977 Fletcher ..... F41G 1/467 124/87
4,656,746 A * 4/1987 Gillespie ..... F41G 1/467 124/87
4,656,747 A * 4/1987 Troncoso ..... F41G 1/467 124/87
4,860,458 A * 8/1989 Ernstsen ..... F41G 1/467 124/87
5,390,657 A * 2/1995 Larson ..... F41B 5/14 124/90
5,762,059 A * 6/1998 Strope ..... F41G 1/467 124/87
5,860,408 A * 1/1999 Summers ..... F41G 1/467 124/87
6,024,079 A * 2/2000 Ingle ..... F41G 1/467 124/87
6,131,295 A * 10/2000 Cranston ..... F41G 1/467 124/87
6,170,164 B1 * 1/2001 Knowles ..... F41G 1/467 124/87
7,621,055 B1 * 11/2009 Brooks ..... F41G 1/467 124/87
8,191,544 B2 * 6/2012 Buck ..... F41G 1/467 124/87
8,898,914 B2 * 12/2014 Bruder ..... F41G 1/467 124/87
2014/0137849 A1 * 5/2014 Small ..... F41B 5/1419 124/87

* cited by examiner

*Primary Examiner* — Alexander Niconovich
(74) *Attorney, Agent, or Firm* — Donald Flaynik

(57) ABSTRACT

A hinged archery sight for a bow for shooting arrows includes a sight portion; a hinge portion for pivotally securing a front member of the hinged archery sight to a back member of the hinged archery sight when a bow string is disposed between the front and back members; and fasteners for securing the front and back members of the hinged archery sight to a bow string.

20 Claims, 10 Drawing Sheets

HINGED ARCHERY SIGHT FOR A BOW FOR SHOOTING ARROWS

BACKGROUND OF THE INVENTION

1. Field of the Invention

The present invention relates generally to archery sights secured to a bowstring, and more particularly, to an archery sight that has a hinged portion that enables front and back portions of the hinged sight to be pivotally secured together on one side such that an opposite side of the hinged sight can be manually "opened" to receive a bowstring, whereupon, fasteners secure portions of the hinged archery about the bowstring.

2. Background of the Prior Art

Prior art archery sights are secured to a bowstring by intertwining the sight with the bowstring, or by securing separated front and back portions of an archery sight about the bowstring, such that the bowstring is ultimately "squeezed" between the front and back portions via fasteners inserted through and manually tightened upon both front and back portions on opposite sides of the bowstring.

A problem arises when an archer attempts to attach a prior art sight upon the bowstring. More specifically, the archer has to hold front and back portions of the sight about the bowstring while aligning cooperating apertures in the front and back portions to receive fasteners that are manually rotated to secure the bowstring between the front and back portions, and between predetermined fasteners. This prior art procedure for securing the sight to the bowstring is problematic in that it takes the archer a relatively excessive amount of time to visually align the apertures in the front and back portions while engaging the bowstring disposed between the front and back portions, which are being held by one hand of the archer. The archer must then secure the front and back portions together via fasteners rotationally secured to the front and back portions. The procedure is especially difficult to complete cold and/or wet climates.

There is a need for an archery sight that promotes pivotal separation of front and back portions of the sight that results in the "opening" of a predetermined portion of the sight to receive a bowstring, and that provides "automatic" alignment between cooperating fastener apertures in the front and back portions when the front and back portions are manually urged together, thereby allowing the archer to manually secure the front and back portions together without the archer having to visually align the cooperating fastener apertures.

SUMMARY OF THE INVENTION

A principal object of the present invention is to provide a hinged archery sight that attaches to an outer portion of a bowstring, and that maintains contact between an archer's line of sight and a target. A feature of the archery sight is front and back portions that are detachably secured about an outer portion of a bowstring. An advantage of the archery sight is that the sight maintains a predetermined position upon the bowstring without intertwinement between the sight and the bowstring. Another advantage of the archery sight is that it maintains contact between an archer's line of sight and a target, irrespective of bowstring stretch and sight twist.

Another principal object of the present invention is to provide a hinged archery sight that promotes pivotal separation of front and back portions of the sight. A feature of the device is a hinge insertion portion that is manually urged into a hinge receiving portion. An advantage of the hinged archery sight is that a portion of the sight "opens" to receive a bowstring. Another advantage of the hinged archery sight is that the sight provides "automatic" alignment between cooperating fastener apertures in the front and back portions when the front and back portions are manually urged together, thereby allowing the archer to manually secure the front and back portions together without the archer having to visually align the cooperating fastener apertures.

Another principal object of the present invention is to maintain pivotal engagement between the hinge insertion portion and the hinge receiving portion irrespective of the position of the hinge insertion portion relative to the hinge receiving portion. A feature of the hinged archery sight is a section of the hinge insertion portion being "force fit" into a cooperating aperture in the hinge receiving portion. An advantage of the hinged archery sight is that no extrinsic elements are required to pivotally secure the hinge insertion portion to the hinge receiving portion.

Another object of the present invention is to minimize wobble of the hinged archery sight after an arrow is shot from the bow. A feature of the archery sight is a center of gravity that is maintained in alignment with the bowstring irrespective of the bowstring stretching with use. An advantage of the device is that the bowstring stretching does not degrade the accuracy of archery sight when aligning an archer's line of sight with a target, irrespective of the archery sight being secured to an outer portion of the bowstring, or being intertwined with the bowstring.

Yet another object of the present invention is to minimize the mass of the archery sight. A feature of the archery sight is a relatively light weight material for fabricating the sight. Another feature of the archery sight is relatively small dimensions for all portions of the sight. An advantage of the sight is that the wobble of the archery sight is minimized after an arrow is shot from the bow.

Still another object of the present invention is to provide a hinged archery sight that can be used for both "right handed" and "left handed" archers. A feature of the hinged archery sight is an oval aperture having a relatively long longitudinal dimension relative to a lateral dimension of the oval aperture. Another feature of the hinged archery sight is an oval aperture having a relatively long longitudinal dimension relative to a longitudinal dimension of the hinged archery sight. An advantage of the hinged archery sight is that the hinged archery sight can be disposed upon a bowstring such that the sight aperture is disposed on the left side of the bowstring relative to the archer for a right handed archer (archer holds the bow with the left hand, draws back the bowstring with the right hand), and such that the sight aperture is disposed on the right side of the bowstring relative to the archer for a left handed archer (archer holds the bow with the right hand, draws back the bowstring with the left hand).

Briefly, the invention provides a hinged archery sight for a bow for shooting arrows that includes a sight portion having an aperture that includes a substantially oval configuration when the hinged archery sight is disposed in a substantially vertical position, and a substantially annular configuration when said hinged archery sight is disposed in a predetermined annular position; a hinge portion for pivotally securing a front member of said hinged archery sight to a back member of the hinged archery sight; and fasteners for rotationally securing the hinged archery sight to a bow string.

Further, the invention provides a hinged archery sight detachably secured to a bow string that includes front and back members that receive a bow string between a back wall of the front member and a front wall of the back member; a sight aperture in a first portion of the detachably secured front and back members; a hinge portion joined to a second portion of the detachably secured front and back members, the hinge portion promoting a pivoting motion between the front and back members when the front and back members are separated and the bow sting is disposed between the back wall of the front member and the front wall of the back member, whereupon, the back wall of the front member is pivotally urged to engage the front wall of the back member to engage the bow string; and fasteners for detachably securing the front member to the back member, whereby, the hinged archery sight is secured to the bow irrespective of vibrations generated when an arrow is shot from an archery bow.

Also, the invention provides an archery sight pivotally secured about a bow string of an archery bow that includes a sight portion; a bow string disposed between predetermined members of an archery sight when the predetermined members are pivotally joined at one portion and separated at an opposing second portion; means for promoting a pivoting motion between the predetermined members; and fasteners for securing the predetermined members together such that the archery sight is maintained upon a selected portion of the bow string, irrespective of vibrations generated by the bow string when an arrow is shot from an archery bow.

BRIEF DESCRIPTION OF THE DRAWINGS

These and other objects, advantages and novel features of the present invention, as well as details of an illustrative embodiment thereof, will be more fully understood from the following detailed description and attached drawings, wherein.

DESCRIPTION OF THE PREFERRED EMBODIMENT

Figure 1:
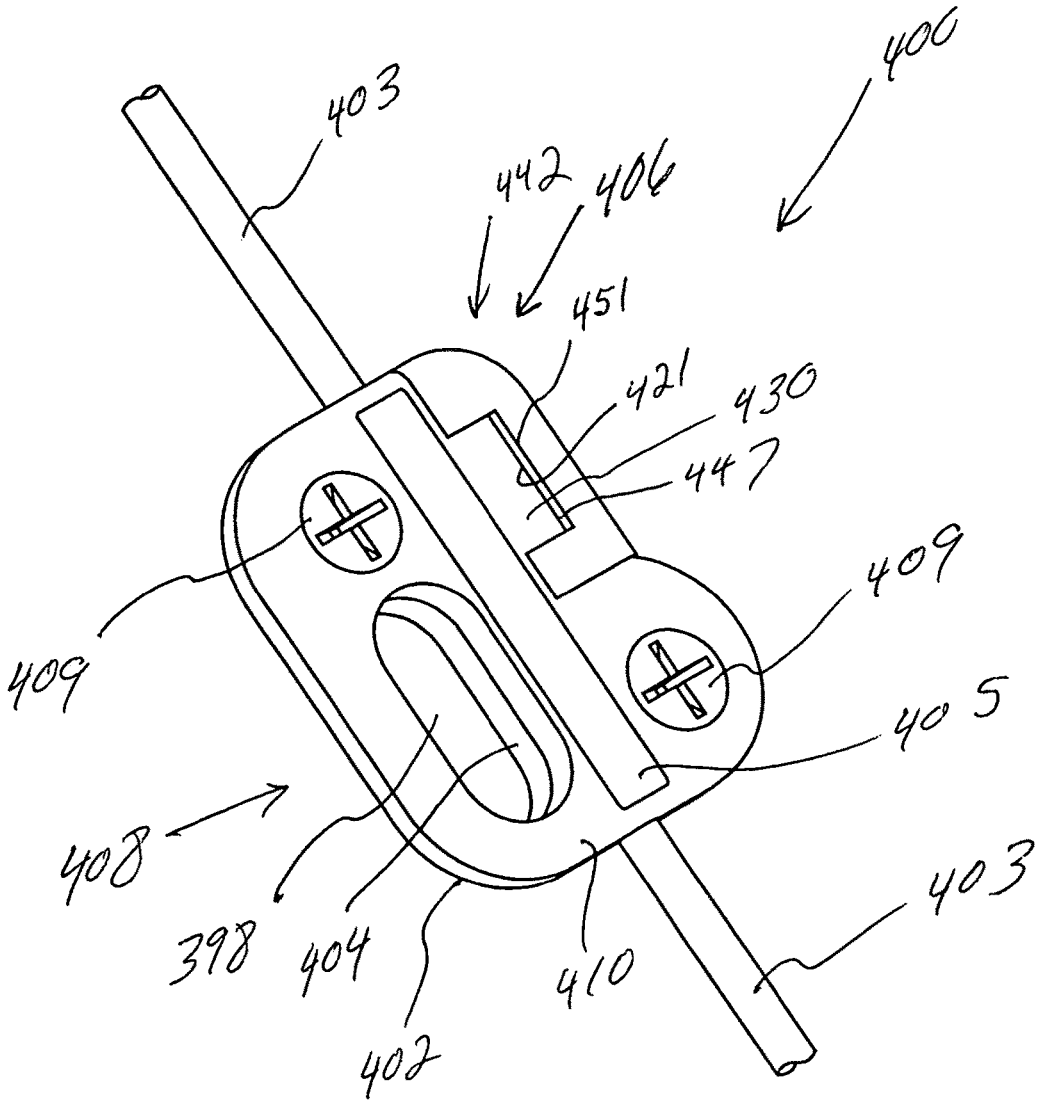
FIG. 1 is a front perspective view of a hinged archery sight in a closed position in accordance with the present invention.
Figure 2:
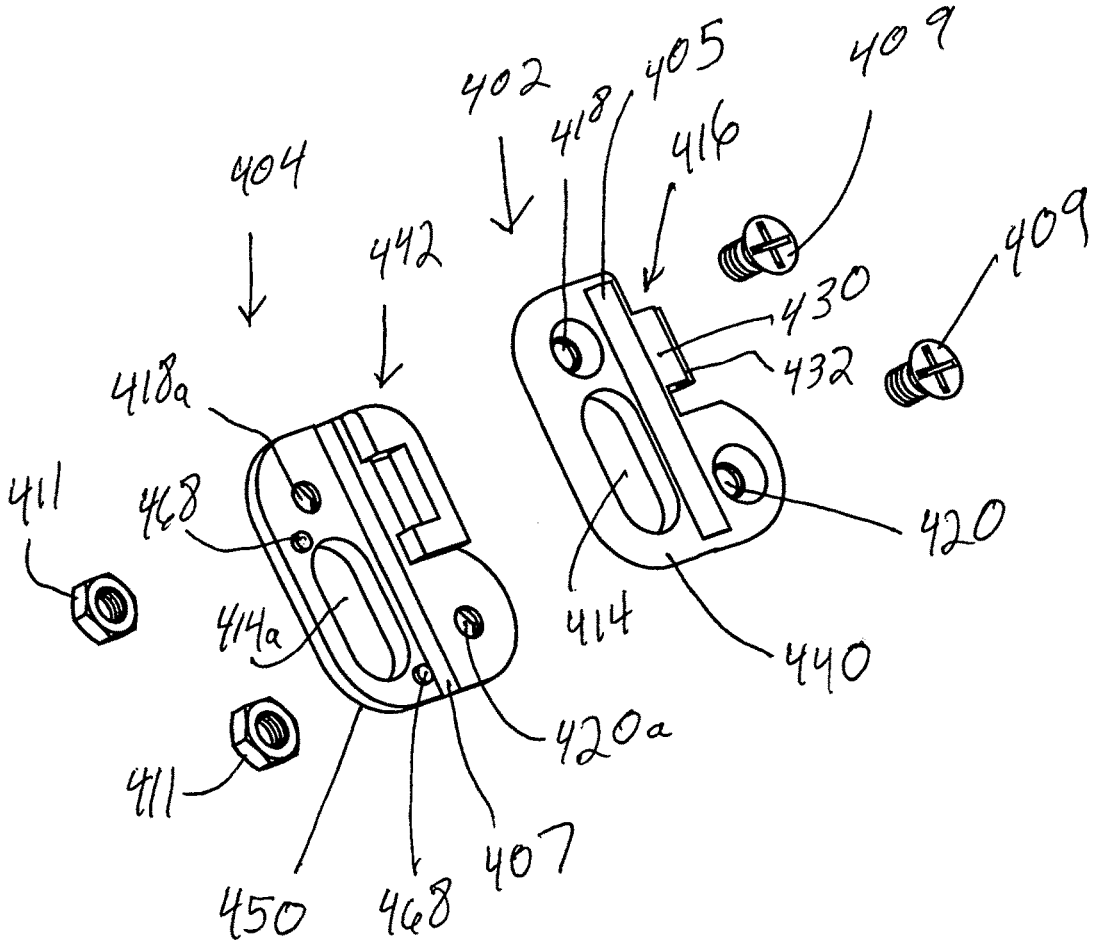
FIG. 2 is an exploded view of the hinged archery sight of FIG. 1.
Figure 3:
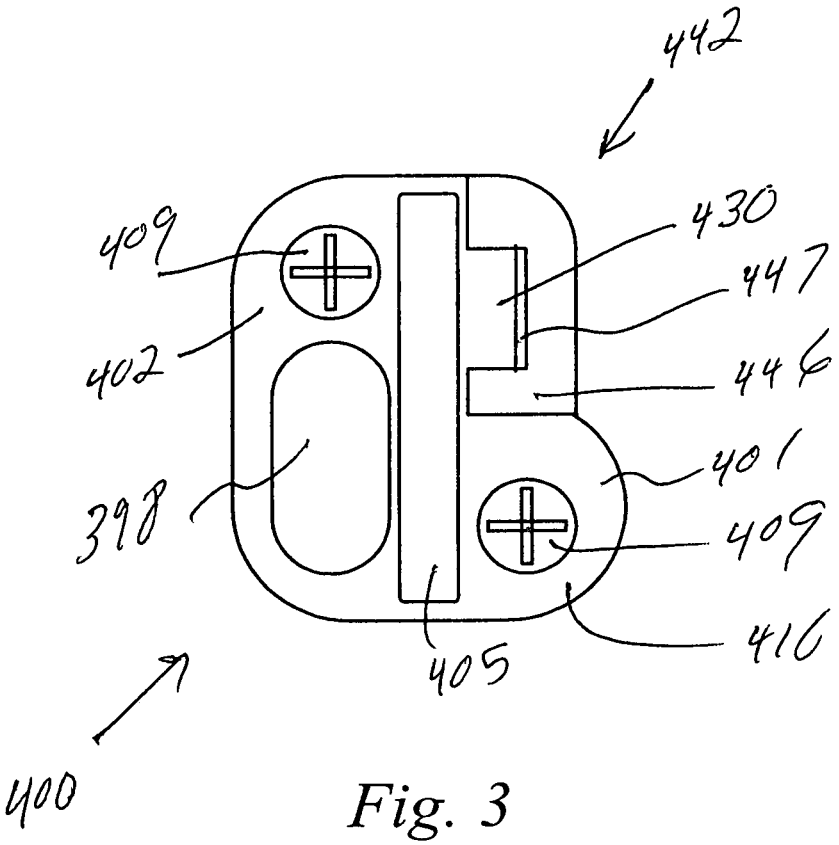
FIG. 3 is a front elevation view of the sight of FIG. 1.
Figure 4:
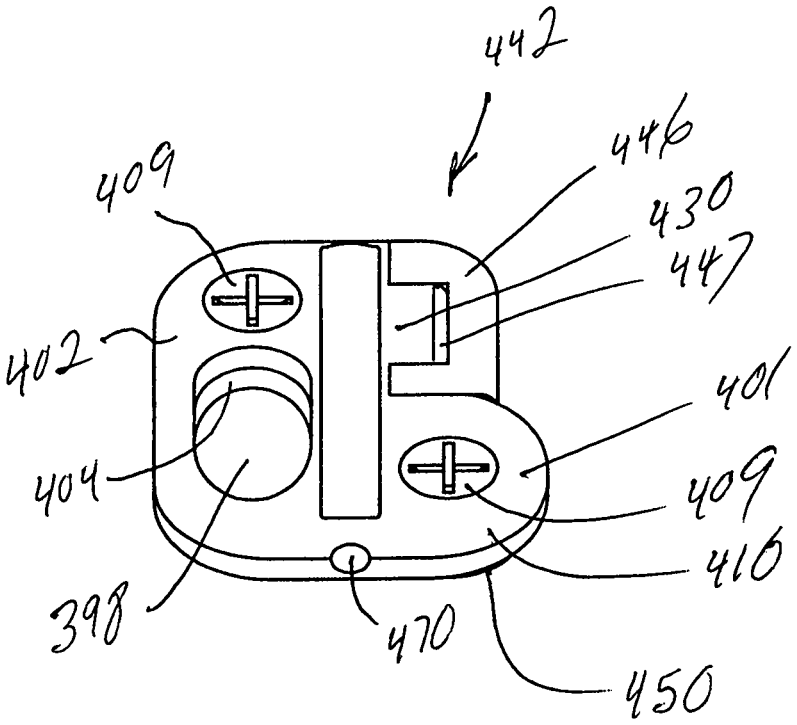
FIG. 4 is a front perspective view of the sight of FIG. 3 in an inclined position when secured to a bow string that has been drawn back by the user of sight.
Figure 5:
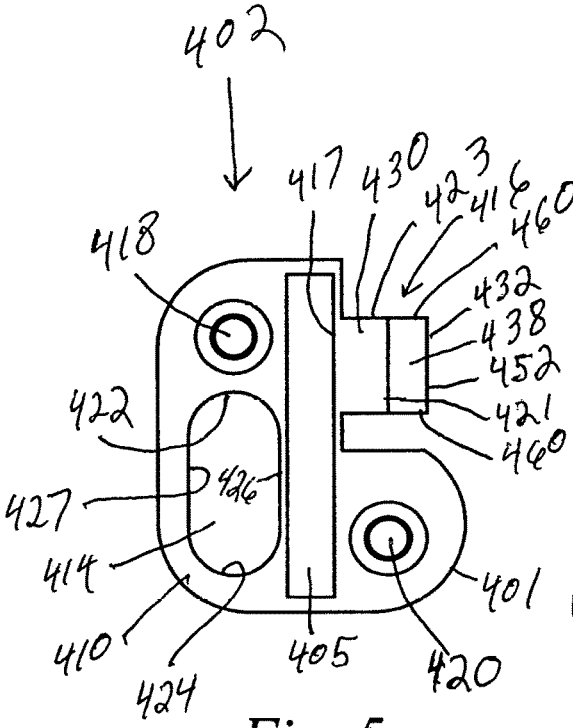
FIG. 5 is a front elevation view of a front portion of the sight of FIG. 1 in accordance with the present invention.
Figure 6:
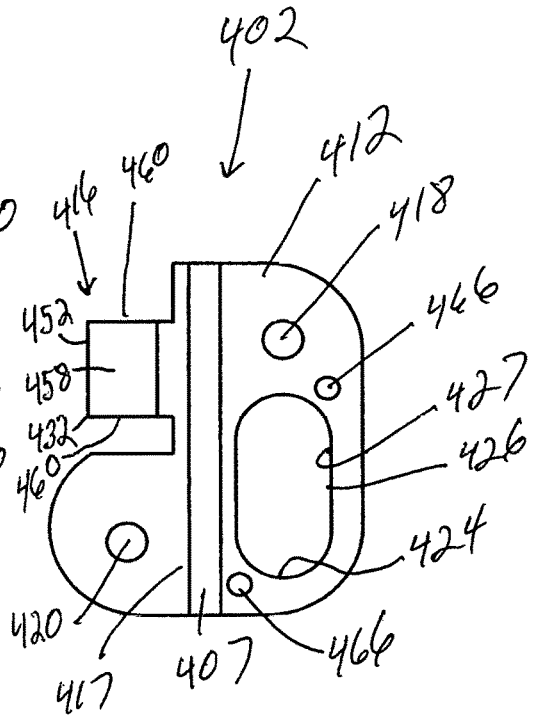
FIG. 6 is a back elevation view of the front portion of FIG. 5.
Figure 7:
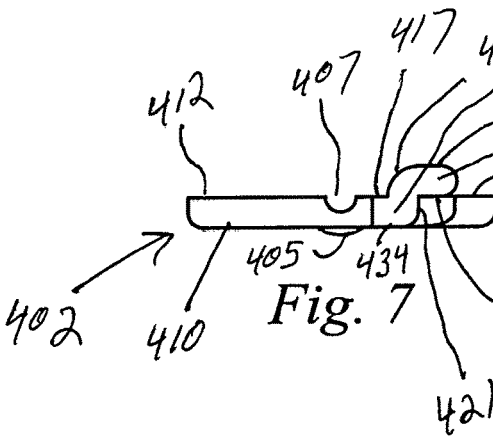
FIG. 7 is a top elevation view of the front elevation view of the front portion of FIG. 5.
Figure 8:
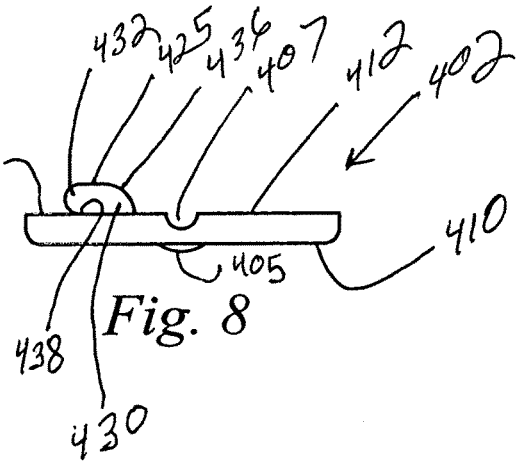
FIG. 8 is a bottom elevation view of the back elevation view of the front portion of FIG. 6.
Figure 9:
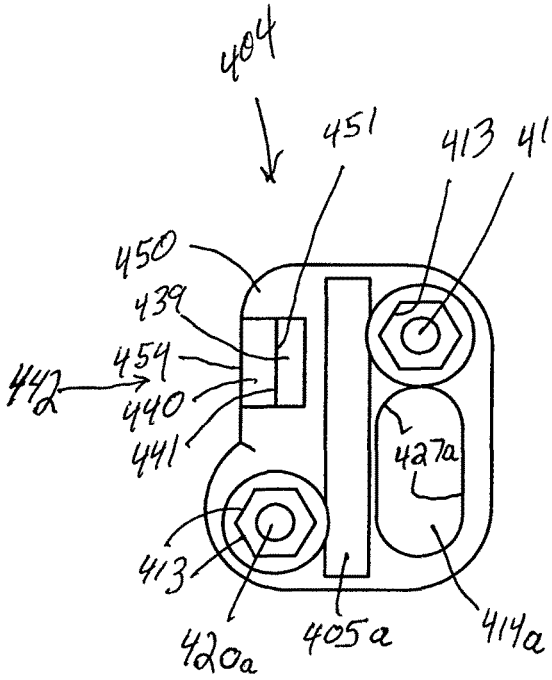
FIG. 9 is a back elevation view of a back portion of the sight of FIG. 1 in accordance with the present invention.
Figure 10:
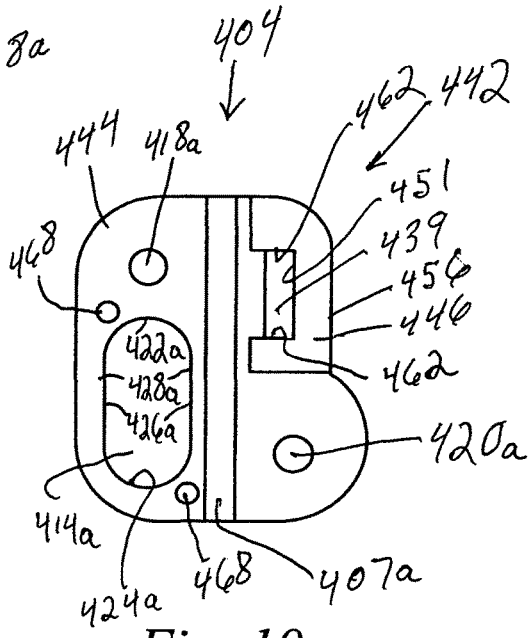
FIG. 10 is a front elevation view of the back portion of FIG. 9.
Figure 11:
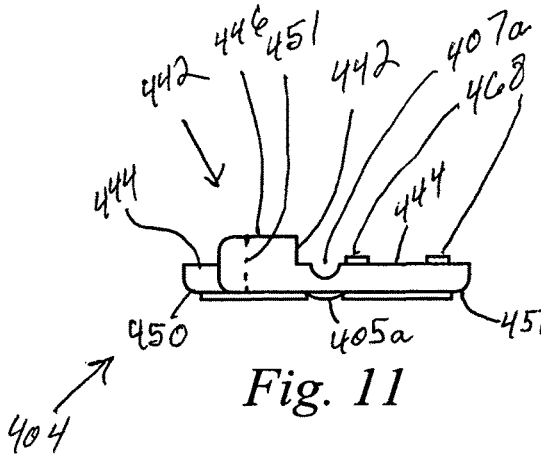
FIG. 11 is a top elevation view of the back elevation view of the back portion of FIG. 9.
Figure 12:
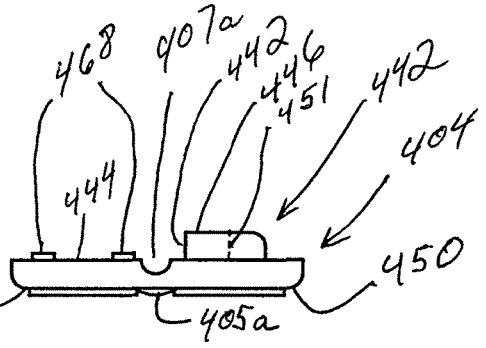
FIG. 12 is a bottom elevation view of the front elevation view of the back portion of FIG. 10.
Figure 14:
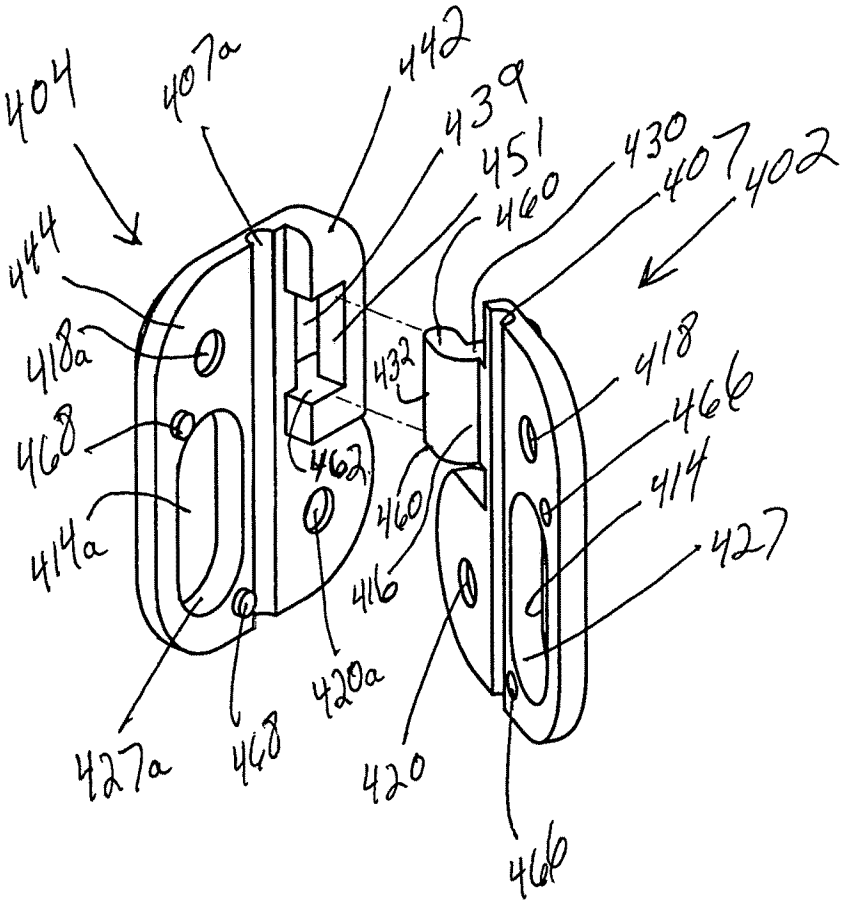
FIG. 14 is a perspective view of the front portion depicted in FIG. 6 being inserted into a back portion depicted in FIG. 10.

Referring now to FIGS. 1-21, a hinged embodiment for an archery sight for a bow for shooting arrows in accordance with the present invention is denoted by numeral 400. The hinged archery sight 400 is fabricated from a relatively rigid, light weight plastic and includes a lower protuberance 401, front and back members 402 and 404 that, when secured together, form a hinged portion 406 at an upper right portion of the sight 400, and a sight portion 408 with sight aperture 398 at a lower left portion of the archery sight 400. A preferred embodiment of the archery sight 400 is its relatively small size and weight that enable the sight 400 to maintain a predetermined position upon a bowstring 403 via two screws 409 and cooperating nuts 411 diagonally disposed on opposite sides of the bow string 403.

The preferred dimensions for the hinged archery sight 400 include a longitudinal dimension of substantially about three-fourths of an inch, a maximum lateral dimension of substantially about five-eighths of an inch, and a maximum "thickness" of substantially about one-eighth of an inch. The weight of the hinged archery sight 400 is substantially about one gram. Although the aforementioned dimensions and weight are preferred for the hinged archery sight 400, dimensions and weights less and greater than those provided can be used for the sight 400 without degrading the performance of the sight 400 or the bow string 403 to which the sight 400 is secured. The configuration, dimensions and weight of the hinged archery sight 400 allows the sight 400 to be used for "right handed" archers (sight portion 408 on left side of bow string 403) and "left handed" archers (sight portion 408 on right side of bow string 403 (not depicted)).

The front member 402 includes front and back substantially planar walls 410 and 412, a longitudinal ridge portion 405 that provides a corresponding longitudinal recess 407, which may include a knurled surface for better "gripping" the string 403, in the back wall 412 that snugly receives the bow string 403, an oval configured sight aperture 414 formed via oval side wall 427 that is perpendicular to the front wall 410 of the front member 402 and a front wall 444 of the back member 404, when taking a front elevation view of the front member 402 (FIG. 5), a hinge insertion portion 416, and first and second funnel configured fastener receiving apertures 418 and 420 for receiving flathead screws 409 to maintain a co-planar surface with the front wall 410. The ridge portion 405 includes a relatively planar peak that is parallel with a longitudinal central axis of the sight 400. The longitudinal central axis is aligned with a center of gravity of the sight 400. The planar peak of the ridge portion 405 is elevated a relatively small distance above the front wall 410. The oval sight aperture 414 includes a longitudinal dimension extending between upper and lower arcuate points 422 and 424, and a lateral dimension extending between midpoints 426 of parallel walls 428. The preferred longitudinal dimension is substantially about four-tenths of an inch, or double the lateral preferred dimension of two-tenths of an inch.

The back member 404 includes front and back substantially planar walls 444 and 450, a longitudinal ridge portion 405*a* that provides a corresponding longitudinal recess 407*a*, which may include a knurled surface for better gripping the string 403, in the back wall 450 that snugly receives the bow string 403, an oval configured sight aperture 414*a* formed via oval side wall 427*a* perpendicular to the front wall 410 of the front portion 402 and the front wall 444 of the back member 404, when taking a front elevation view of the back member 404 (FIG. 10), a hinge receiving portion 442, and first and second fastener receiving apertures 418*a* and 420*a* that include retaining walls 413 perpendicular to and secured to the back wall 450 to prevent the nuts 411 from rotating when receiving rotating screws 409 that secure the front portion 402 to the back portion 404. The ridge portion 405*a* includes a relatively planar peak that is parallel with a longitudinal central axis of the sight 400. The longitudinal central axis is aligned with a center of gravity of the sight 400. The planar peak of the ridge portion 405*a* is elevated a relatively small distance above the front wall 444.

The oval sight aperture 414*a* includes a longitudinal dimension extending between upper and lower arcuate points 422*a* and 424*a*, and a lateral dimension extending between midpoints 426*a* of parallel walls 428*a*. The preferred longitudinal dimension is substantially about four-tenths of an inch, or double the lateral preferred dimension of two-tenths of an inch. Except for the hinge receiving portion 414*a* and the nut retaining walls 413, the front wall 410 of the front member 402 is substantially a congruent mirror image of the back wall 450 of the back member 404. Except for the hinge receiving portion 442; and locking pegs 466 integrally joined to the back wall of the front member 402, and locking peg receiving recesses 468 in the front wall 444 of the back member 404, the back wall 412 of the front member 402 is substantially a mirror image of the front wall 444 of the back member 404.

Figure 13:
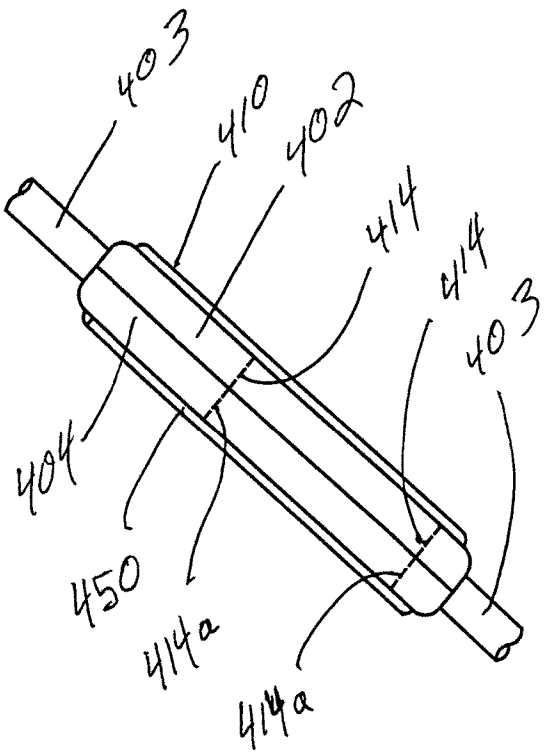
FIG. 13 is a left side elevation view of the sight of FIG. 4, but with the sight secured to a bow string.
Figure 15:
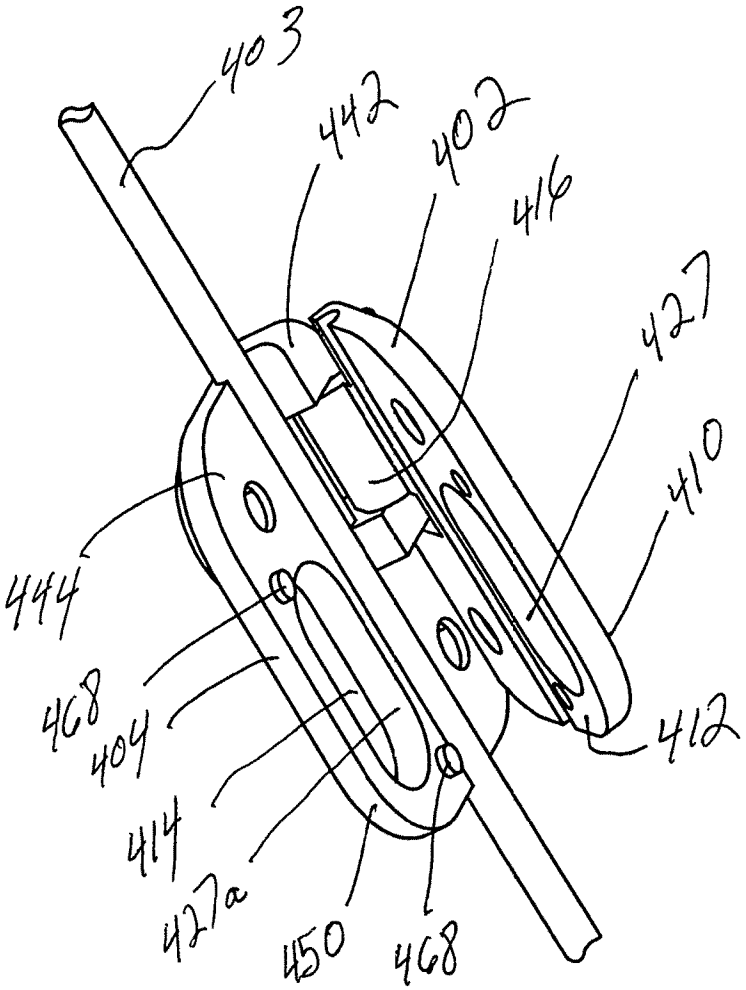
FIG. 15 is a front perspective view of a hinged archery sight in an open position in accordance with the present invention.
Figure 16:
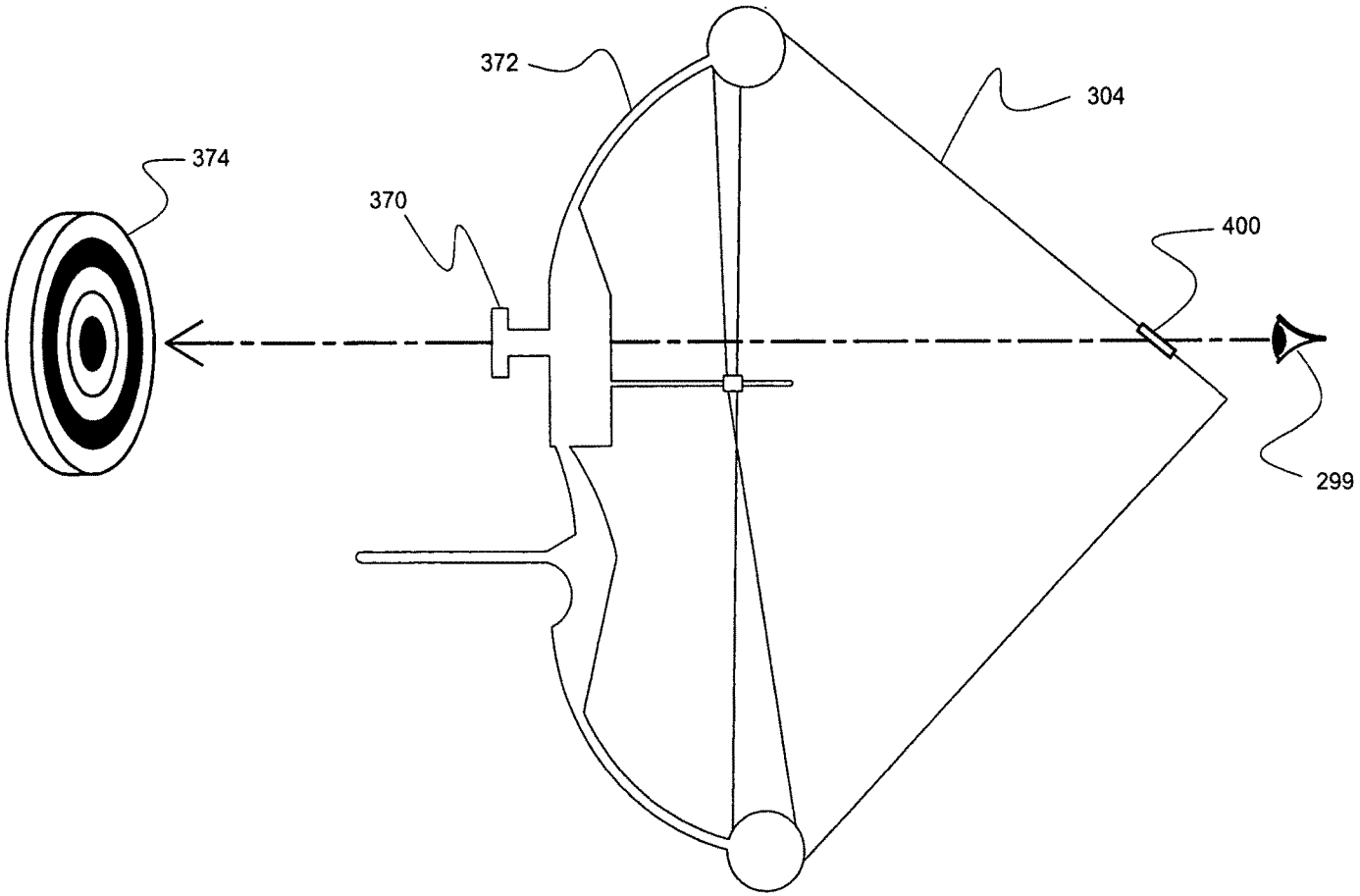
FIG. 16 is a side elevation view of a drawn bow string with a hinged archery sight secured the string, and a line of sight from an archers "eye," through the hinged archery sight and extending toward a target.
Figure 17:
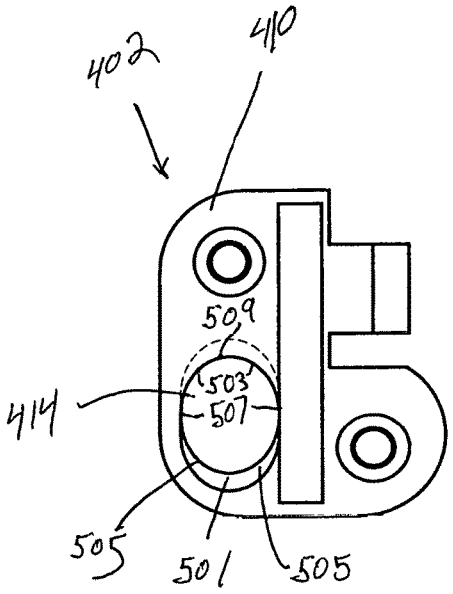
FIG. 17 is a front elevation view of a front portion of the sight of FIG. 1, but with an oval aperture sight having inclined arcuate side walls that form the aperture in accordance with the present invention.
Figure 18:
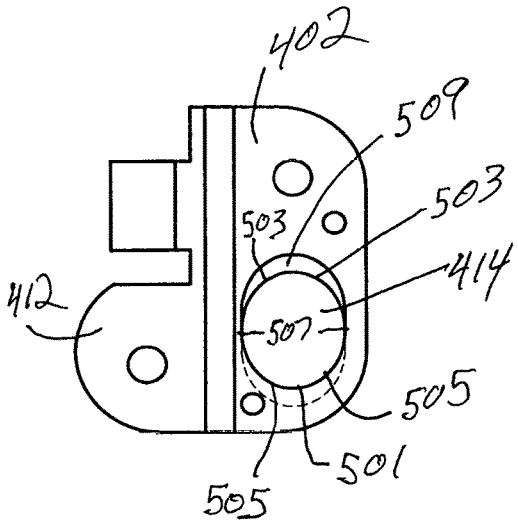
FIG. 18 is a back elevation view of the front portion of the sight of FIG. 17.
Figure 19:
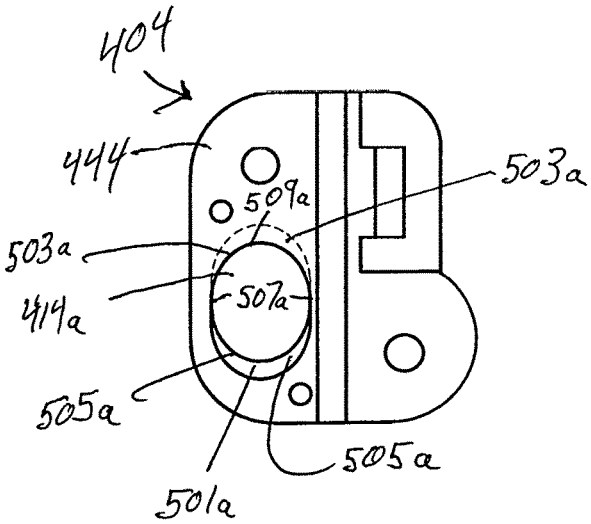
FIG. 19 is a front elevation view of a back portion of the sight of FIG. 1, but with an oval aperture sight having inclined arcuate side walls that form the aperture in accordance with the present invention
Figure 20:
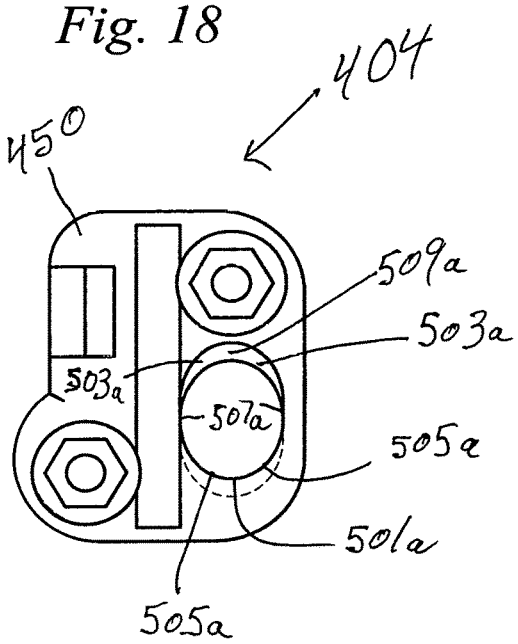
FIG. 20 is a back elevation view of the back portion of the sight of FIG. 19.
Figure 21:
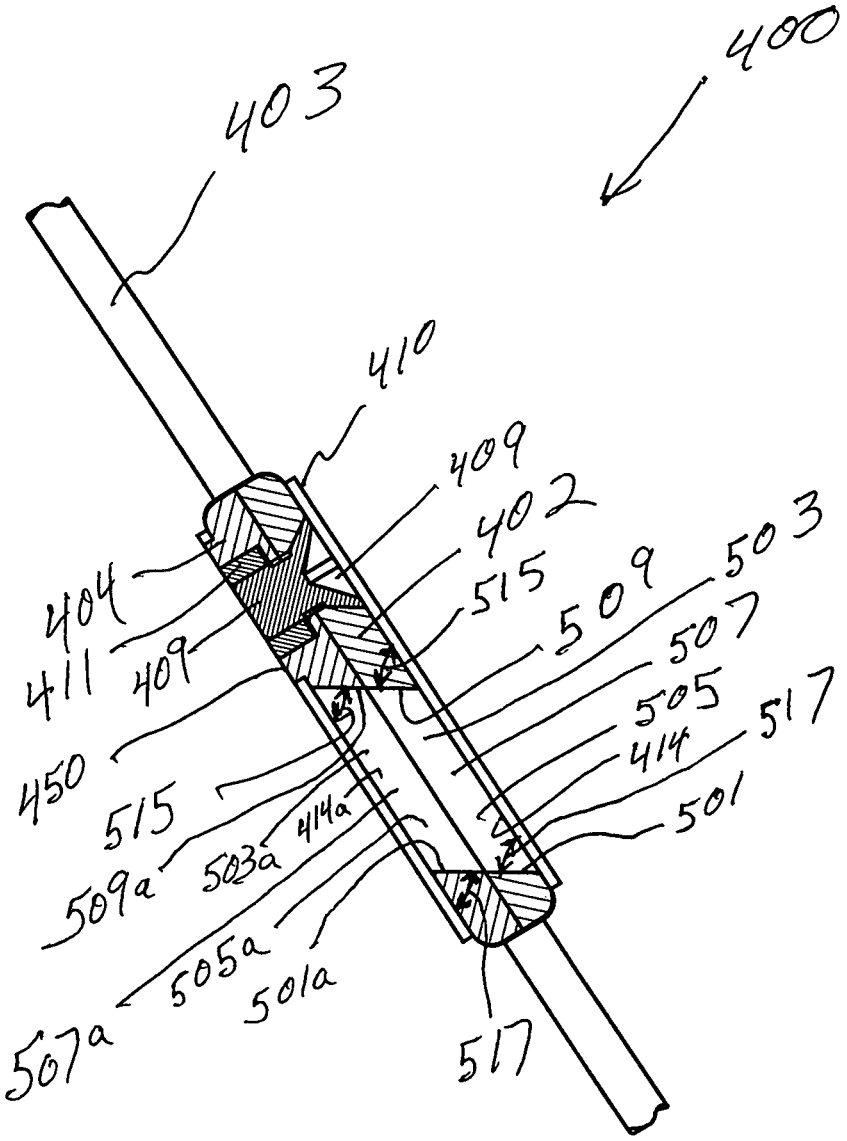
FIG. 21 is a left side, sectional elevation view of the hinged archery sight of FIG. 4, but with the sight secured to a bow string and with the oval aperture of the hinged archery sight having inclined arcuate side walls that form the aperture in accordance with the present invention.

The configuration, dimensions and light weight of the hinged archery sight 400 allows the sight 400 to be used for "right handed" archers (sight aperture 398 on the left side of the bow string 403 when the bow is vertically positioned) or "left handed" archers (sight aperture 398 on the right side of the bow string 403 when the bow is vertically positioned). Further, the configuration and dimensions of the hinged archery sight 400 promotes an oval sight aperture 398 configuration when the sight 400 is secured to a bow string 403 disposed in a substantially vertical position, and a substantially circular or annular sight aperture 398 configuration when the sight is secured to a bow string 403 manually drawn toward the user to an angular position that is substantially about thirty-two to thirty-three degrees as depicted in FIGS. 13, 16 and 21.

Referring to FIGS. (5-8, and 14), the hinge insertion portion 416 includes, when taking a front elevation view of the front member 402, a rectangular configured inner section 430 integrally joined to a rectangular configured outer section 432. The inner section 430 is integrally joined to a first longitudinal wall 417 of the ridge portion 405, such that a front planar wall 434 of the inner section 430 is coplanar with the front wall 410 of the front member 402, and a back inclined planar wall 436 of the inner section 430 angularly extends from the first longitudinal wall 417 and distally from the back wall 412 of the front member 402 to form a back planar wall 425 of the outer section 432. Further, the inner section 430 includes lateral side walls 423 that are perpendicular to the first wall 417 of the ridge portion 405; and a longitudinal side wall 421 that is parallel to the first wall 417 of the ridge portion 405, the side wall 421 also being perpendicular to a top wall 438 of the outer section 432. The longitudinal side wall 421 and the back inclined wall 436 of the inner section 430 cooperate to offset the outer section 432 from the inner section 430 such that a front wall 438 of the outer section 432 is coplanar with the back wall 412 of the front member 402 to enable the outer section 432 to angularly insert (see FIGS. 14 and 15) into a hinge receiving aperture 439 in the back member 404, thereby allowing the front and back members 402 and 404 to be manually urged from an initial angled orientation to a position where the back wall 412 of the front member 402 engages a front wall 444 of the back member 404 to form the hinged bow sight 400.

As the outer section 432 is angularly inserted into the hinge receiving aperture 439, the top wall 438 of the outer section 432 ultimately engages an edge portion 441 of a bottom wall 440 of a hinge receiving portion 442 integrally joined to the front wall 444 of the back member 404. The hinge receiving portion 442 is configured such that side walls 462 elevate the bottom wall 440 a relatively short distance above the front wall 444 of the back member 404, thereby allowing the outer section 432 to angularly and snugly slide under and engages the edge portion 441 of the bottom wall 440 while the back wall 412 of the front member 402 is manually urged toward the front wall 444 of the back member 404, and the top wall 438 of the outer section 432 is manually urged toward the bottom wall 440 of the hinge receiving portion 442.

Ultimately, the back wall 412 congruently engages cooperating portions of the front wall 444, resulting in the top wall 434 of the inner section 430 being co-planar with a top wall 446 of the hinge receiving portion 442; the bottom wall 436 of the inner section 430 engaging the front wall 444 of the back member 404; and substantially all of the top wall 438 of the outer section 432 engaging all of the bottom wall 440 of the hinge receiving portion 442, thereby providing a relatively small gap 447 between the side wall 421 of the inner section 430 and a side wall 451 of the hinge receiving portion 442.

Further, when the back wall 412 congruently engages cooperating portions of the front wall 444, a bottom wall 448 of the outer section 432 becomes co-planar with a back planar wall 450 of the back member 404; and an end wall 452 of the outer section 432 becomes co-planar with a side wall portion 454 of the back member 404 and an outer side wall 456 of the hinge receiving portion 442.

The gap 447 between the side wall 421 of the inner section 430 and the side wall 451 of the hinge receiving portion 442, and the engagement of the top wall 438 of the outer section 432 with the edge portion 441 of the bottom wall 440 of the hinge receiving portion 442, promote a pivoting action between the side walls 460 of the outer section 432 and the cooperating aperture side walls 462 of the hinge receiving portion 442. The pivoting action is achieved via a force fit relationship between the side walls 460 of the outer section 432 and the aperture side walls 462 of the hinge receiving portion 442 due to a relatively larger distance separating the side walls 460 of the outer section 432 in comparison to the distance separating the aperture side walls 462. The respective side walls 460 and 462 maintain engagement and promote a pivoting motion during angular separation of the front and back members 402 and 404 to positions that allow the bow string 403 to be inserted into the bow string recess 407*a* in the back member 404; whereupon, the front and back members 402 and 404 are secured together via fasteners and nuts 409 and 411, and locking pegs 466 integrally joined to and extending from the back wall 412 of the front member 402, and diagonally disposed adjacent to respective arcuate portions of the oval sight aperture 414. The locking pegs 466 are configured and dimensioned to snugly insert into cooperating locking peg receiving recesses 468 in the front wall 444 of the back member 404.

In operation, an outer section 432 of a hinge insertion portion 416 of a front member 402 of hinged archery sight 400 is manually and angularly inserted into a hinge receiving aperture 439 in a hinge receiving portion 442 of a back member 404 of a hinged archery sight 400 for a bow string 403 for shooting arrows. After the outer section 432 is angularly inserted into the receiving aperture 439, the angular position of the front member 402 relative to the back member 404 is maintained via the relatively greater dimension of an end wall 452 of the outer section 432 being manually forced into a smaller distance of separation between aperture side walls 462 of the hinge receiving portion 442. The user of the hinged bow sight 400 is then able to hold the sight 400 with one hand and position the sight 400 such that the bow string 403 is disposed between the front and back members 402 and 404. The user then urges the front and back members 402 and 404 together via the outer section 432 of the insertion portion 416 cooperating with the side walls 462 of the receiving portion 442 to provide a pivoting motion between the front and back members 402 and 404, until the top wall 438 of the outer section 432 is disposed in substantial planar engagement with the bottom wall 440 of the receiving portion 442, thereby forming the hinged portion 406 of the sight 400.

As the front and back members 402 and 404 are manually urged together, the bow string 403, generally about one-tenth of an inch in diameter, is snugly received by and secured in the joined bow string recesses 407 and 407*a*, which form a bow string aperture 470 having a diameter substantially about 0.08 inches, that ultimately crimps the bow string 403 between the recesses 407 and 407*a* without damaging the string 403. The two screws 409 are then rotationally inserted into cooperating nuts 411 and the locking pegs 466 snugly inserted into cooperating peg recesses 468 until the bow sight 400 is secured to the bow string 403, such that the sight 400 can be manually slid upon the bow string 403 to a position that optimizes the sight 400 accuracy for the respective user. The screws 409 are then tightened such that the sight 400 maintains its optimum position upon the string 403, irrespective of the string 403 vibrations generated when an arrow is "fired" from the bow by the user. In the event that the sight 400 needs to be repositioned upon the bow string 403, the user need only loosen the screws 409 sufficiently to allow the user to slide the sight 400 upon the string 403 to a new position selected by the user.

Referring now to FIGS. 17-21, to maintain the accuracy of the hinged bow sight 400 when the hinged bow sight 400 is disposed in an angular position substantially less than thirty-two degrees, the oval sight aperture 398 is formed via front and back oval sight apertures 414 and 414*a* in respective front and back portions 402 and 404 that have been joined together. The combined oval sight apertures 414 and 414*a* include upper inclined walls 500 and 500*a*, and lower inclined walls 502 and 502*a* formed via upper sloping wall portion 503 and 503*a*, and cooperating but opposite sloping lower wall portion 505 and 505*a*. Further, the apertures 414 and 414*a* include two opposite lateral midportion walls 507 and 507*a*, both being perpendicular to the front walls 410 and 444, and back walls 412 and 450 of respective front and back members 402 and 404. The apertures 414 and 414*a* also include one upper maximum sloping or inclined wall portion 509 and 509*a*, respectively, and one lower maximum oppositely sloping wall portion 501 and 501*a*, respectively.

Both the upper maximum sloping wall portions 509 and 509*a*, and the oppositely maximum sloping lower wall portions 501 and 501*a* form respective upper and lower acute angles 515 and 517 (see FIG. 21) with the front and back walls 410 and 450. The upper maximum inclined wall portion 509 and 509*a* is disposed at a midportion of the upper sloping wall portion 503 and 503*a*, and the lower maximum inclined wall portion 501 and 501*a* is disposed at a midportion of the lower sloping wall portion 505 and 505*a*. The combined aperture sights 414 and 414*a* include changing slopes for the sloping wall portions 503 and 503*a*, and 505 and 505*a*, respectively, to provide sharp edges for the archer's eye to view and align the sight portion 408 with a bow sight 370 attached to a bow 372, irrespective of the bowstring drawback by the archer, thereby providing increased accuracy when shooting the arrow at a target 374.

In a preferred embodiment, the arcuate, inclined upper wall 503 and 503*a* begins at one of the two lateral walls 507 and 507*a* that are perpendicular to the front and back walls 410 and 450. The upper wall 503 and 503*a* then arcuately extends upward to the upper maximum sloping wall portion 509 and 509*a* at an inclined angle or slope that continually and proportionately is increased from the lateral wall 507 and 507*a* to the upper wall portion 509 and 509*a*, which forms an angle 515 substantially about thirty-two to thirty-three degrees with the front and back walls 410 and 450. The inclined, maximum sloping upper wall portion 509 and 509*a* extends from the front wall 410 to the back wall 450. The arcuate, inclined upper wall 503 and 503*a* then arcuately extends downward from the upper maximum sloping wall portion 509 and 509*a* to the other or second lateral wall 507 and 507*a* at an inclined angle or slope that continually and proportionately is reduced from the upper, maximum sloping wall portion 509 and 509*a* until lineally joining the second sidewall 507 and 507*a*, thereby forming a perpendicular wall portion 507 and 507*a* with the front and back walls 410 and 450 at only the sidewall 507 and 507*a*, which is at the lateral midportion of the aperture sight portion 414 and 414*a*.

The slope of the inclined lower wall 505 and 505*a* can be in the same direction as the slope of the inclined upper wall 503 and 503*a*, thereby forming a "full-funnel" configuration with walls combined walls 503 and 503*a*, and walls 505 and 505*a* having varying slopes of straight line or curved configurations, however, optimum sight 414 and 414*a* accuracy is achieved by configuring the slope of the inclined lower wall 505 and 505*a* in a reverse or opposite direction to the slope of the inclined upper wall 503 and 503*a*. Thus, the lower wall 505 and 505*a* extends from the sidewall 507 and 507*a* to the lower, maximum sloping wall portion 501 and 501*a*, whereupon the lower wall portion 501 and 501*a* forms and angle 517 with the front and back walls 410 and 450 substantially about thirty-two to thirty-three degrees. The lower wall portion 505 and 505*a* then continually and proportionately extends upward from the lower wall portion 501 and 501*a* to the original side wall 507 and 507*a* such that the slope of the lower wall 505 and 505*a* relative to the front and back walls 410 and 450 is reduced from substantially about thirty-two to thirty-three degrees until the lower wall 505 and 505*a* becomes perpendicular with the front and back walls 410 and 450 at the original or first side wall 507 and 507*a*. The thirty-two to thirty-three degrees of angle 515 and 517 can vary more or less than the optimum specification, however, the hinged archery sight 400 accuracy will correspondingly be reduced with the variations of the degrees of the angles 515 and 517.

The foregoing description is for purposes of illustration only and is not intended to limit the scope of protection accorded this invention. The scope of protection is to be measured by the following claims, which should be interpreted as broadly as the inventive contribution permits.

The invention claimed is:

1. A hinged archery sight for a bow for shooting arrows comprising:

a discrete front member having a hinge forming portion;

a discrete back member having a hinge forming portion for removably receiving said hinge forming portion of said discrete front member, thereby forming a hinge portion for pivotally and detachably securing said discrete front member to said discrete back member;

a sight portion formed when said discrete front member is detachably secured to said discrete back member;

a bowstring aperture for receiving a bowstring, said bowstring aperture formed by a recess in a back wall of said front member, said back wall recess being longitudinally aligned with a cooperating recess in a front wall of said back member, said bowstring aperture being disposed between two fasteners; and at least one pointed spike integrally joined to an arcuate wall of said recess in said back wall of said front member, and at least one pointed spike integrally joined to an arcuate wall of said recess in said front wall of said back member, said spikes being longitudinally separated a distance that prevents said spikes after penetrating the bowstring from damaging the bow string when vibrations are generated when shooting arrows; whereby, said hinged archery sight is maintained at an optimum position upon a bowstring irrespective of vibrations generated by the bowstring when shooting arrows.

2. The hinged archery sight of claim 1 wherein said at least one pointed spike joined to said arcuate wall of said recess in said back wall, and said at least one pointed spike joined to said arcuate wall of said recess in said front wall are longitudinally separated a predetermined distance of substantially about one-eighth of an inch.

3. The hinged archery sight of claim 2 wherein said pointed spikes are radially orientated such that a pointed end portion of said pointed projections ultimately penetrate a bowstring until said pointed end portion is disposed proximate to a center portion of the bowstring.

4. A hinged archery sight for a bow for shooting arrows comprising:

a hinge portion for pivotally securing a front member of said hinged archery sight to a back member of said hinged archery sight, said hinge portion being disposed proximate to an upper first side portion of said hinged archery sight;

a sight portion, said sight portion being disposed proximate to a lower second side portion of said hinged archery sight;

a bowstring aperture for receiving a bowstring, said bowstring aperture formed by a recess in a back wall of said front member, said back wall recess being longitudinally aligned with a cooperating recess in a front wall of said back member, said bowstring aperture being disposed between said hinge portion and an upper fastener disposed proximate to an upper second side portion of said hinged archery sight, and said bowstring aperture being disposed between said sight portion and a lower fastener disposed proximate to a lower first side portion of said hinged archery sight, said bowstring aperture including an enlarged bottom end portion having a diameter substantially the same as the diameter of the bowstring, thereby avoiding a pivoting action that is generated when a bowstring diameter is greater than the diameter of said bowstring aperture, said pivoting action being capable of generating a force sufficient to separate said front and back members at a bottom end portion of said hinged archery sight, said enlarged bottom end portion of said bowstring aperture ultimately reducing frictional degradation of said front and back members, and said archery sight and the bowstring, while maintaining an optimum predetermined position for said archery sight upon the bowstring; and at least one pointed projection integrally joined to an arcuate wall of said recess in said back wall of said front member, and at least one pointed projection integrally joined to an arcuate wall of said recess in said front wall of said back member; whereby, said hinged archery sight is maintained at an optimum position upon a bowstring irrespective of vibrations generated by the bowstring when shooting an arrow.

5. The hinged archery sight of claim 4 wherein said enlarged bottom end portion is cylindrically configured.

6. The hinged archery sight of claim 4 wherein said enlarged bottom end portion includes a tapered configuration that begins at a common diameter for an upper portion of the bowstring aperture and said enlarged bottom end portion, the diameter of said enlarged bottom end portion constantly increasing from the common diameter until said bottom end portion of said bowstring aperture engages a bottom end wall of said hinged archery sight.

7. The hinged archery sight of claim 1 wherein said hinge portion includes a hinge insertion portion forcibly urged into a hinge receiving portion such that said front member of said hinged archery sight is angularly and pivotally secured to said back member of said hinged archery sight.

8. The hinged archery sight of claim 7 wherein said hinge insertion portion includes, when taking a front elevation view of said front portion, a rectangular configured inner section integrally joined to a rectangular configured outer section, said inner section being integrally joined to a first longitudinal wall of a ridge portion of said front member, such that a front planar wall of said inner section is coplanar with said front wall of said front member, and a back inclined planar wall of said inner section angularly extends from said first longitudinal wall of said ridge portion and distally from said back wall of said front member to form a back planar wall for said outer section.

9. The hinged archery sight of claim 8 wherein said inner section of said hinge insertion portion includes lateral side walls that are perpendicular to said first longitudinal wall of said ridge portion; and a longitudinal side wall that is parallel to said first longitudinal wall of said ridge portion, said longitudinal side wall of said inner section also being perpendicular to a top wall of said outer section of said hinge insertion portion.

10. The hinged archery sight of claim 9 wherein said longitudinal side wall of said inner section of said hinge insertion portion cooperates with said back inclined wall of said inner section to offset said outer section of said hinge insertion portion from said inner section, such that a top wall of said outer section of said hinge insertion portion is coplanar with and engages said back wall of said front member of said hinged archery sight to enable said outer section of said hinge insertion portion to angularly insert into a hinge receiving aperture in a hinge receiving portion of said back member of said hinged archery sight, thereby allowing said front and back members of said hinged archery sight to be manually urged from an initial angled orientation to a position where said back wall of said front member of said hinged archery sight engages a front wall of said back member of said hinged archery sight.

11. The hinged archery sight of claim 10 wherein said top wall of said outer section of said hinge insertion portion ultimately engages an edge portion of a bottom wall of a hinge receiving portion integrally joined to said front wall of said back member of said hinged archery sight, said hinge receiving portion including side walls that elevate said bottom wall of said hinge receiving portion a relatively short distance above said front wall of said back member of said hinged archery sight, thereby allowing said outer portion to angularly and snugly slide under and engage said edge portion of said bottom wall when said back wall of said front member of said hinged archery sight is manually urged toward said front wall of said back member of said hinged archery sight; and when said top wall of said outer section of said hinge insertion portion is manually urged toward said bottom wall of said hinge receiving portion.

12. The hinged archery sight of claim 11 wherein said top wall of said inner section is co-planar with a top wall of said hinge receiving portion, and said bottom wall of said inner section engages said front wall of said back member of said hinged archery sight; and substantially all of said top wall of said outer section engages all of said bottom wall of said hinged receiving portion, thereby providing a relatively small gap between an end wall off said inner section of said insertion portion and a side wall of said hinge receiving portion.

13. The hinged archery sight of claim 12 wherein said back wall of said front member of said hinged archery sight congruently engages cooperating wall portions of said front wall of said back member of said hinged archery sight; a bottom wall of said outer section of said hinge insertion portion is co-planar with a back planar wall of said back member of said hinged archery sight; and an end wall of said outer section of said hinge insertion portion is co-planar with a side wall portion of said back member of said hinged archery sight, said end wall being co-planar with an outer side wall of said hinge receiving portion.

14. The hinged archery sight of claim 13 wherein said gap between said end wall of said inner section and said side wall of said hinge receiving portion promotes a pivoting action between said side walls of said outer section engaging cooperating aperture side walls of said hinge receiving portion, said pivoting action being achieved via a force fit relationship between said side walls of said outer section and said aperture side wall of said hinge receiving portion due to a relatively larger distance separating said side walls of said outer section than the distance separating said aperture side walls, said side walls of said outer section and said aperture side walls maintaining engagement and a pivoting motion during angular separation of outer side walls of said sight portion of said hinged archery sight, said angular separation of said front and back members allowing a bowstring to be inserted into a bowstring recess in said front wall of said back member of said hinged archery sight; whereupon, said front and back members of said hinged archery sight are detachably secured together via securing means.

15. The hinged archery sight of claim 1 wherein said sight portion includes an oval configured sight aperture having oppositely inclined walls relative to a front planar wall of said front member and a back planar wall of said back member, said oppositely inclined walls joining side walls that are perpendicular to said front wall of said front member and said back wall of said back member of said hinged archery sight.

16. The hinged archery sight of claim 15 wherein said arcuate oppositely inclined walls of said sight portion includes an arcuate, inclined upper wall beginning at a first one of the two lateral side walls that are perpendicular to said front and back walls of said front and back members of said hinged archery sight, said upper wall arcuately extending upward to an upper maximum sloping wall portion at an inclined slope that continually and proportionately increases from said first lateral side wall to said upper maximum sloping wall portion that forms a predetermined angle with said front and back walls, said inclined maximum sloping upper wall portion extending from said front wall to said back wall, said arcuate inclined upper wall arcuately extending downward from said upper maximum sloping wall portion to a second lateral side wall at an inclined slope that continually and proportionately reduces from said upper maximum sloping wall portion until joining said second side wall, thereby forming a second side wall that is perpendicular to said front and back walls of said front and back members of said hinged archery sight.

17. The hinged archery sight of claim 16 wherein said arcuate oppositely inclined walls of said sight portion includes an arcuate, inclined lower wall extending downward from said second sidewall to a lower, maximum sloping wall portion at an inclined slope that continually and proportionately increases from said second lateral side wall to said lower maximum sloping wall portion that forms a predetermined angle with said front and back walls, said arcuate inclined lower wall arcuately extending upward from said lower maximum sloping wall portion to said first lateral side wall at an inclined slope that continually and proportionately reduces from said lower maximum sloping wall portion until joining said first lateral side wall, thereby forming a first side wall that is perpendicular to said front and back walls of said front and back members of said hinged archery sight.

18. The hinged archery sight of claim 17 wherein said upper maximum inclined wall portion includes a slope opposite to a slope of said lower maximum inclined wall portion such that when said hinged archery sight is vertically positioned, said aperture sight includes an oval configuration when taking a front elevation view of said hinged archery sight, said upper maximum inclined wall portion includes a slope opposite to a slope of said lower maximum inclined wall portion such that when said hinged archer sight is vertically positioned, said aperture sight includes an annular configuration when taking a front elevation view of said hinged archery sight, said oppositely inclined upper and lower wall portions of said sight portion form respective upper and lower acute angles with said front and back walls of said respective front and back members of said hinged archery sight.

19. A hinged archery sight detachably secured to a bow string comprising:

a discrete front member having a hinge forming portion;

a discrete back member having a hinge forming portion for removably receiving said hinge forming portion of said discrete front member, thereby forming a hinge portion for pivotally and detachably securing said discrete front member to said discrete back member;

a sight portion formed when said discrete front member is detachably secured to said discrete back member;

a bowstring aperture for receiving a bowstring, said bowstring aperture formed by a recess in a back wall of said front member, said back wall recess being longitudinally aligned with a cooperating recess in a front wall of said back member, said bowstring aperture being disposed between two fasteners; and an enlarged bottom end portion of said bowstring aperture having a diameter substantially the same as the diameter of the bowstring, thereby avoiding a pivoting action that is generated when a bowstring diameter is greater than the diameter of said bowstring aperture, said pivoting action being capable of generating a force sufficient to separate said front and back members at a bottom end portion of said hinged archery sight; whereby, said enlarged bottom end portion of said bowstring aperture reduces frictional degradation of said front and back members, said archery sight and the bowstring, while maintaining an optimum predetermined position for said archery sight upon the bowstring.

20. The hinged archery sight of claim 1 wherein said bowstring aperture includes an enlarged bottom end portion having a diameter substantially the same as the diameter of the bowstring, thereby avoiding a pivoting action that is generated when a bowstring diameter is greater than the diameter of said bowstring aperture, said pivoting action being capable of generating a force sufficient to separate said front and back members at a bottom end portion of said hinged archery sight, said enlarged bottom end portion of said bowstring aperture ultimately reducing frictional degradation of said front and back members, and said archery sight and the bowstring, while maintaining an optimum predetermined position for said archery sight upon the bowstring.

* * * * *